US009448515B2

(12) United States Patent
Yamakawa et al.

(10) Patent No.: US 9,448,515 B2
(45) Date of Patent: Sep. 20, 2016

(54) FIXING DEVICE AND IMAGE FORMING APPARATUS

(71) Applicant: KYOCERA Document Solutions Inc., Osaka (JP)

(72) Inventors: Tomohiko Yamakawa, Osaka (JP); Masaru Takagi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/684,836

(22) Filed: Apr. 13, 2015

(65) Prior Publication Data

US 2015/0301485 A1 Oct. 22, 2015

(30) Foreign Application Priority Data

Apr. 16, 2014 (JP) ..... 2014-084531

(51) Int. Cl.
*G03G 15/20* (2006.01)
*G03G 21/16* (2006.01)

(52) U.S. Cl.
CPC ..... *G03G 15/206* (2013.01); *G03G 15/2053* (2013.01); *G03G 21/1642* (2013.01); *G03G 2221/1639* (2013.01); *G03G 2221/1654* (2013.01)

(58) Field of Classification Search
CPC ..... G03G 15/2017; G03G 21/1647; G03G 2221/1639; G03G 2221/1651; G03G 2221/1654; G03G 15/206
USPC ..... 399/320, 328, 330
See application file for complete search history.

(56) References Cited

U.S. PATENT DOCUMENTS 5,543,903 A * 8/1996 Fujita et al. ..... 399/327
8,107,870 B2 1/2012 Inoue et al.
2009/0185840 A1 7/2009 Inoue et al.
2013/0336607 A1* 12/2013 Hirose et al. ..... 384/397

FOREIGN PATENT DOCUMENTS

JP 2009-169256 A 7/2009

* cited by examiner

*Primary Examiner* — Benjamin Schmitt
(74) *Attorney, Agent, or Firm* — Studebaker & Brackett PC

(57) ABSTRACT

A fixing device fixes a toner to a recording medium. The fixing device includes a rotary member, a bearing, and a bearing holder. The rotary member is rotatable about an axis of rotation of the rotary member. The bearing is disposed around an end part of the rotary member. The bearing holder holds the bearing. The bearing has an outer circumferential surface with a flat portion and a bearing groove. The bearing groove has a bottom surface, a first side surface, and a second side surface. The first side surface of the bearing groove is capable of being in contact with the bearing holder. The second side surface of the bearing groove is capable of being in contact with the bearing holder. The bearing holder is engaged with the bearing groove such as to be in contact with the first and second side surfaces of the bearing groove.

10 Claims, 5 Drawing Sheets

FIXING DEVICE AND IMAGE FORMING APPARATUS

INCORPORATION BY REFERENCE

The present application claims priority under 35 U.S.C. §119 to Japanese Patent Application No. 2014-084531, filed Apr. 16, 2014. The contents of this application are incorporated herein by reference in their entirety.

BACKGROUND

The present disclosure relates to fixing devices and image forming apparatuses.

Electrographic image forming apparatuses include a fixing device that fixes a toner image to a sheet by applying heat and pressure to the sheet. Such a fixing device includes a rotary member (e.g., a heating roller or a pressure roller) having an end part at which a bearing member for the rotary member is provided. The bearing promotes smooth rotation of the rotary member. A holder (stopper ring) is used to fix the bearing to a frame. A certain fixing device regulates the press contact state between a fixing roller and a pressure roller to apply appropriate pressure to the rollers, thereby achieving stable fixing operation.

SUMMARY

A fixing device according to the present disclosure fixes a toner to a recording medium. The fixing device includes a rotary member, a bearing, and a bearing holder. The rotary member is rotatable about an axis of rotation of the rotary member. The bearing is disposed around an end part of the rotary member. The bearing holder holds the bearing. The bearing has an outer circumferential surface with a flat portion and a bearing groove. The bearing groove has a bottom surface, a first side surface, and a second side surface. The first side surface of the bearing groove is capable of being in contact with the bearing holder. The second side surface of the bearing groove is capable of being in contact with the bearing holder. The bearing holder is engaged with the bearing groove such as to be in contact with the first and second side surfaces of the bearing groove.

An image forming apparatus according to the present disclosure includes the fixing device and an image forming section. The image forming section transfers a toner image to a recording medium. The fixing device fixes the toner image to the recording medium.

DETAILED DESCRIPTION

Figure 1A:
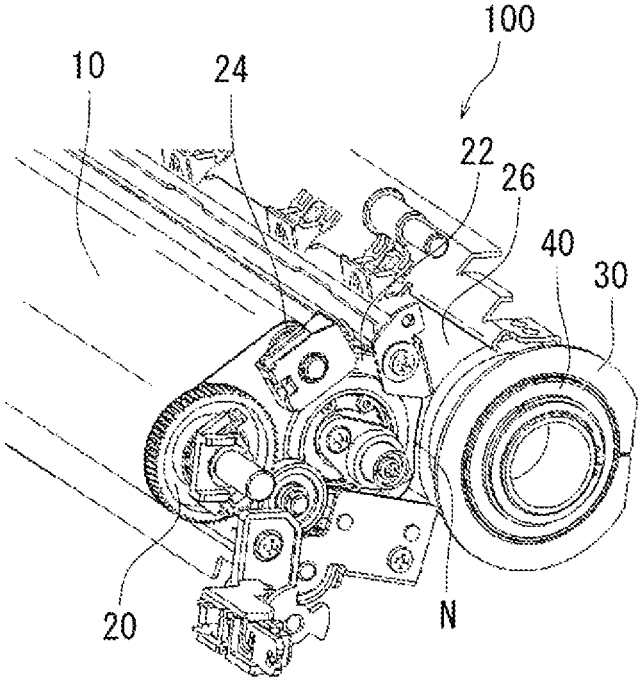
FIG. 1A is a perspective view of a fixing device according to a first embodiment of the present disclosure.

Embodiments of the present disclosure will be described below with reference to the accompanying drawings. Like numerals denote like elements or corresponding elements in the drawings, and duplicate description shall be omitted.

First Embodiment

Figure 1B:
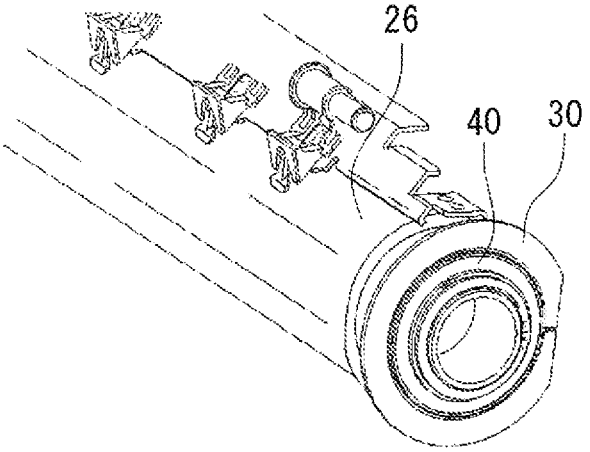
FIG. 1B is a perspective view of a pressure roller of the fixing device according to the first embodiment of the present disclosure.

Description will be made below about a fixing device 100 according to a first embodiment of the present disclosure with reference to FIGS. 1A and 1B. FIG. 1A is a perspective view of the fixing device 100 according to the first embodiment of the present disclosure. FIG. 1B is a perspective view of a pressure roller 26 of the fixing device 100 according to the first embodiment of the present disclosure.

The fixing device 100 includes a pressure roller 26 (a rotary member), a bearing 40, and a bearing holder 30. The fixing device 100 may be mounted in an image forming apparatus, for example. The fixing device 100 further includes a heating roller 20, a fixing roller 22, a tension roller 24, and an endless belt 10. The fixing device 100 fixes toner to a sheet (a recording medium) in a manner to melt unfixed toner on the sheet by applying heat and pressure to the sheet.

The heating roller 20, the fixing roller 22, the tension roller 24, and the pressure roller 26 are cylindrical. The heating roller 20, the fixing roller 22, the tension roller 24, and the pressure roller 26 are rotatable about their axes of rotation. The belt 10 is wound around the heating roller 20, the fixing roller 22, and the tension roller 24. The tension roller 24 applies tension to the belt 10.

The pressure roller 26 is driven to rotate by a power source not illustrated.

The heating roller 20 has an outer circumferential surface. The belt 10 is wound to the outer circumferential surface of the heating roller 20. The pressure roller 26 circulates the belt 10. Circulation of the belt 10 drives to rotate the heating roller 20.

A heater is provided in the interior of the heating roller 20. The heater may be a halogen heater, ceramic heater, or carbon heater, for example. The heater heats the belt 10 via the heating roller 20. The heater extends in terms of the axial direction of the heating roller 20. The heater is arranged in parallel to the axis of rotation of the heating roller 20.

The bearing 40 is located around the outer circumferential surface at an end part of the pressure roller 26. The bearing 40 has an outer circumferential surface. The bearing holder 30 holds the bearing 40. The bearing 40 and the bearing holder 30 will be described later in detail with reference to FIGS. 3A and 3B.

The pressure roller 26 adjacent to the fixing roller 22 is driven to rotate by the power source in the fixing device 100. Rotation of the pressure roller 26 generates a friction force between the pressure roller 26 and the belt 10 and between the belt 10 and the fixing roller 22 to drive to rotate the fixing roller 22. In response to the fixing roller 22 being driven to rotate, the belt 10 runs. The heater maintains the belt 10 at a predetermined temperature. To supply sufficient heat to a sheet and unfixed toner, the pressure roller 26 presses the fixing roller 22 to form a nip part N. The sheet is conveyed by the belt 10 maintained at the predetermined temperature and passes through the nip part N. Thus, the unfixed toner is pressed and attached to the sheet.

Figure 2:
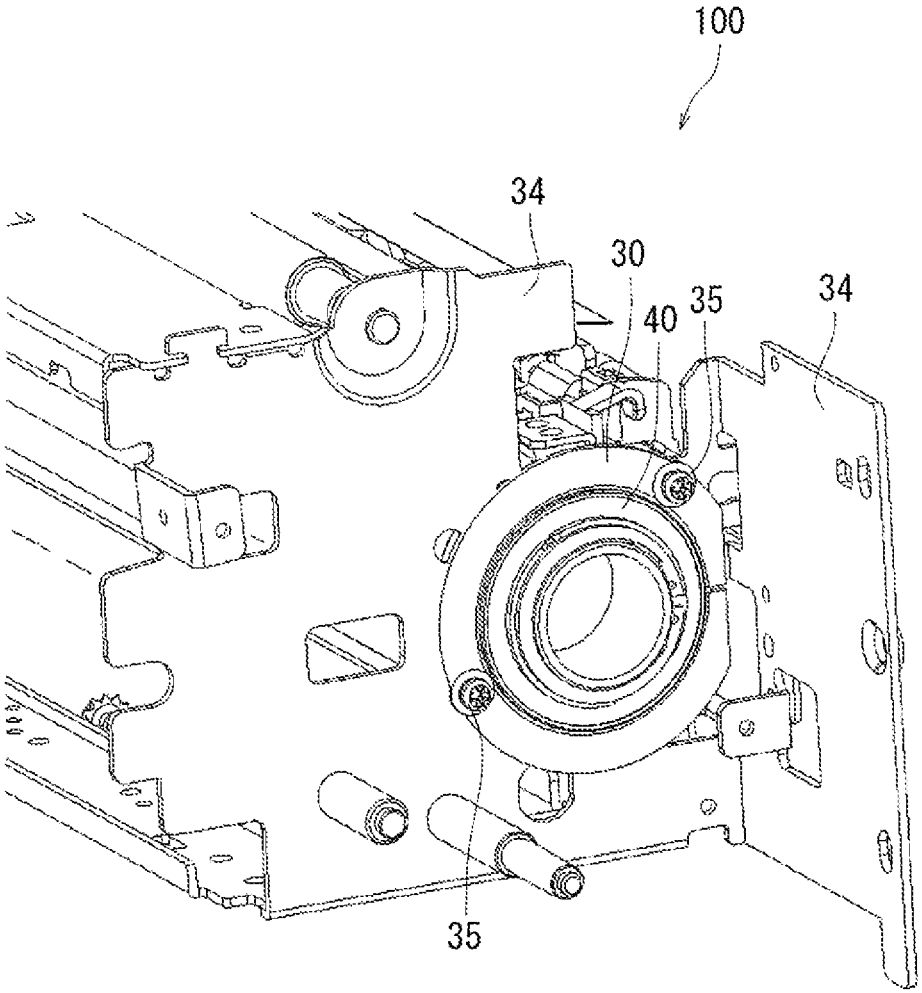
FIG. 2 is a perspective view of the fixing device according to the first embodiment of the present disclosure.

A method of mounting the bearing holder 30 in the fixing device 100 in the present disclosure will be described with reference to FIG. 2. FIG. 2 is a perspective view of the fixing device 100 according to the first embodiment of the present disclosure.

The fixing device 100 further includes a stationary frame 34. The bearing holder 30 is mounted on the stationary frame 34 by means of screws 35.

Figure 3A:
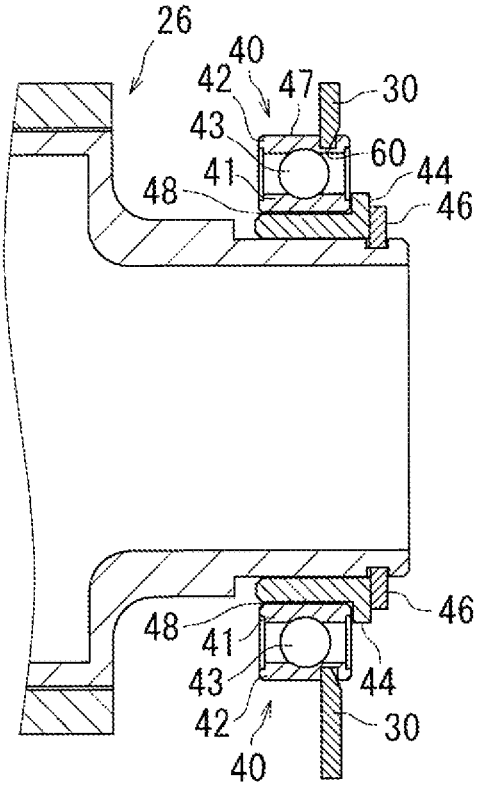
FIG. 3A is a cross sectional view of the vicinity of a bearing of the fixing device according to the first embodiment of the present disclosure.
Figure 3B:
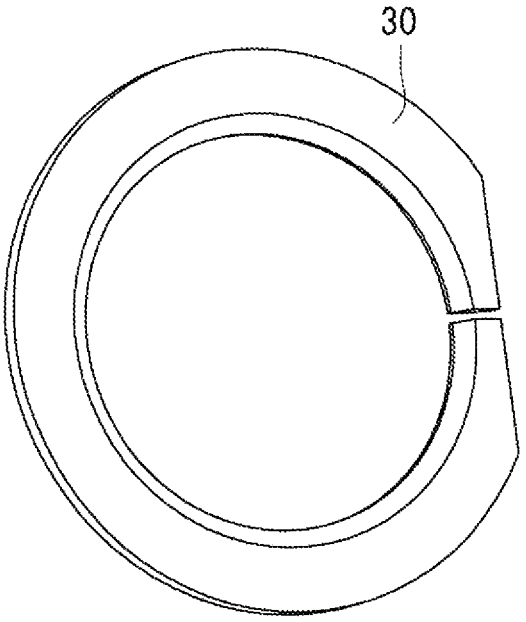
FIG. 3B is a perspective view of a bearing holder of the fixing device according to the first embodiment of the present disclosure.

Description will be made below about the fixing device 100 according to the first embodiment of the present disclosure with reference to FIGS. 3A and 3B. FIG. 3A is a cross sectional view of the vicinity of the bearing 40 of the fixing device 100 according to the first embodiment of the present disclosure. FIG. 3B is a perspective view of the bearing holder 30 of the fixing device 100 according to the first embodiment of the present disclosure.

The fixing device 100 further includes a heat insulator 44 and a pressing member 46.

The bearing 40 is disposed around an end part of the pressure roller 26. The bearing 40 is fitted around the outer circumferential surface of the pressure roller 26 with the heat insulator 44 therebetween. The bearing 40 has an inner circumferential surface 48 and an outer circumferential surface 47. The inner circumferential surface 48 of the bearing 40 is in contact with the outer circumferential surface of the heat insulator 44. Heat from the pressure roller 26 is absorbed by the heat insulator 44 and not conducted directly to the bearing 40, so that the bearing 40 will not be heated excessively. The bearing 40 rotatably supports the pressure roller 26. The bearing 40 includes an inner ring 41, an outer ring 42, and a plurality of balls 43. The balls 43 are arranged at regular intervals between the inner ring 41 and the outer ring 42. The bearing 40 promotes smooth rotation of the pressure roller 26.

The bearing holder 30 holds the bearing 40. The bearing holder 30 has a C-shape (an interrupted annular shape). The inner diameter of the bearing holder 30 is slightly smaller than the outer diameter of the bearing 40. When the bearing holder 30 is mounted on the bearing 40, residual stress is generated in the bearing holder 30 to throttle the bearing 40 toward the center of the bearing 40. The bearing holder 30 is made from a metal or a resin. A resin having high heat resistance is preferably used in a case where the bearing holder 30 is made from a resin. The bearing holder 30 may be made from polyphenylene sulfide (PPS), for example. The pressing member 46 is provided to prevent the pressure roller 26 from falling off in terms of the axial direction of the pressure roller 26.

Figure 4:
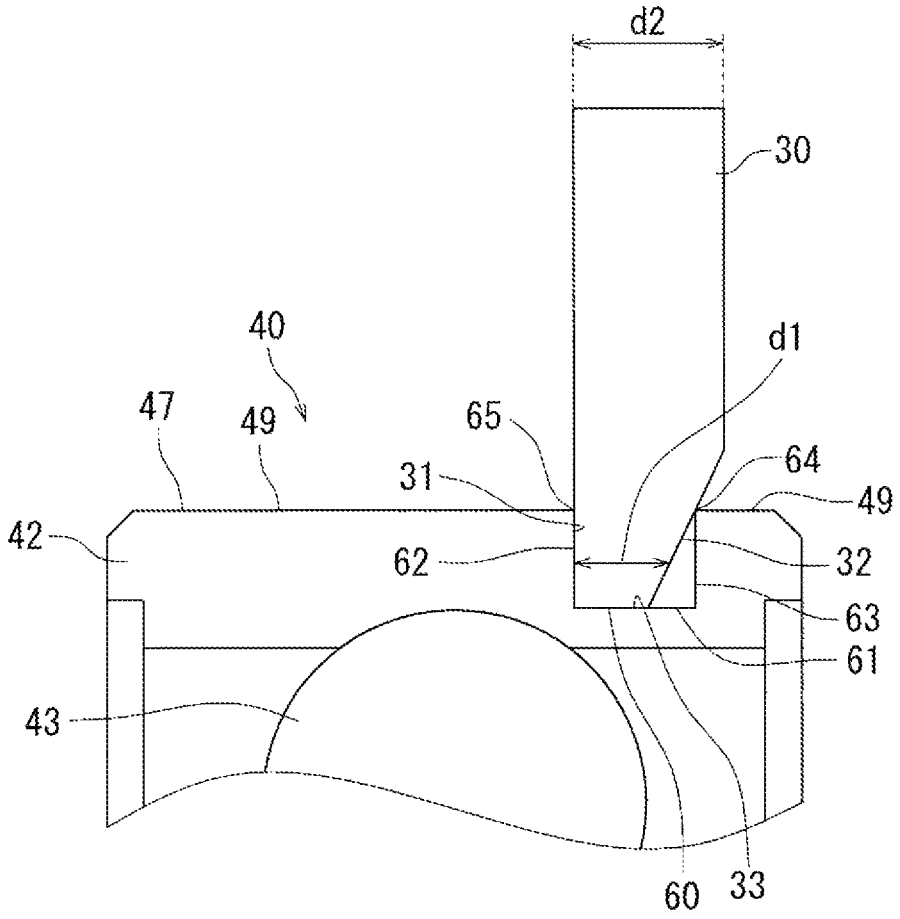
FIG. 4 is an enlarged view of FIG. 3A illustrating the vicinity of the bearing.

The fixing device 100 according to the first embodiment of the present disclosure will be described with reference to FIG. 4. FIG. 4 is an enlarged view of FIG. 3A illustrating the vicinity of the bearing 40.

The outer circumferential surface 47 of the bearing 40 has a flat portion 49 and a bearing groove 60. The flat portion 49 is a portion of the outer circumferential surface 47 that is flat. The bearing groove 60 has a bottom surface 61, a first side surface 62, a second side surface 63, a first rim 65, and a second rim 64. The bearing groove 60 is defined by the bottom surface 61 and the first and second side surfaces 62 and 63. The first side surface 62 is capable of being in contact with the bearing holder 30. The second side surface 63 is capable of being in contact with the bearing holder 30. The first side surface 62 faces the second side surface 63. The first side surface 62 and the flat portion 49 forms the first rim 65. The second side surface 63 and the flat portion 49 forms the second rim 64.

The bearing holder 30 has a first contact surface 31, a second contact surface 32, and a connecting surface 33 that connects the first contact surface 31 to the second contact surface 32. The bearing holder 30 is engaged with the bearing groove 60 such as to be in contact with the first and second side surfaces 62 and 63 of the bearing groove 60. Specifically, the first contact surface 31 of the bearing holder 30 is in contact with the first side surface 62 of the bearing groove 60, while the second contact surface 32 the bearing holder 30 is in contact with the second side surface 63 of the bearing groove 60.

The bearing holder 30 is also in contact with the bearing 40 at least at the same level of the flat portion 49 of the outer circumferential surface 47 of the bearing 40. Specifically, the bearing holder 30 is in contact with at least the first and second rims 65 and 64 of the bearing groove 60. Here, the first contact surface 31 is in contact with the entirety of the first side surface 62, while the second contact surface 32 is in contact with an abutting part of the second side surface 63 (the second rim 64). The bearing holder 30 has a thickness (a length in terms of the axial direction of the pressure roller 26) d1 on the inside of the bearing groove 60 and a thickness (a length in terms of the axial direction of the pressure roller 26) d2 on the outside of the bearing groove 60. The thickness d1 is smaller than the thickness d2. The second contact surface 32 inclines relative to the direction perpendicular to the axis of rotation of the pressure roller 26 (radial direction of the pressure roller 26). A part of the second contact surface 32 accordingly is in contact with the abutting part (the second rim 64 herein). Here, the bearing holder 30 is engaged with the bearing groove 60 such that the first contact surface 31 is in parallel to the radial direction of the pressure roller 26.

As has been described with reference to FIGS. 1A-4, the bearing holder 30 is engaged with the bearing groove 60 of the bearing 40 in the fixing device 100 so as to be in contact with the first and second side surfaces 62 and 63 of the bearing groove 60. In a traditional fixing device with a bearing holder having a rectangular cross section, a gap is present between the bearing groove and the bearing holder on account of a margin, so that the bearing holder is in contact with only one of the side surfaces of the bearing groove. By contrast, in the present embodiment, the two side surfaces of the bearing holder 30 are in contact with the bearing groove 60. Therefore, the bearing holder 30 can reliably be engaged with the bearing groove 60 when compared with the rectangular bearing holder. Further, the bearing holder 30 applies a force toward the axis of rotation of the pressure roller 26. This configuration can reduce wobbling of the bearing 40 on the pressure roller (rotary member) 26, thereby reducing noise.

The bearing holder 30 is in contact with the bearing 40 at at least the first and second rims 65 and 64 of the bearing 40. The bearing holder 30 can accordingly be engaged with the bearing groove further reliably.

The thickness d1 of the bearing holder 3 on the inside of the bearing groove 60 is smaller than the thickness d2 thereof on the outside of the bearing groove 60. Further, the width of the bearing groove 60 in the axial direction of the pressure roller 26 is greater than the thickness d1 of the bearing holder 30 on the inside of the bearing groove 60 and smaller than the thickness d2 thereof on the outside of the bearing groove 60. Thus, the bearing 40 is hard to be displaced relative to the bearing holder 30. As a result, the bearing 40 can be stably held.

At least one of the first and second contact surfaces 31 and 32 of the bearing holder 30 inclines relative to the radial direction of the pressure roller 26. In the configuration as above, the inclined first or second contact surface 31 or 32 is in contact with a part of the corresponding first or second side surface 62 or 63. As a result, the bearing holder 30 can hold the bearing 40 having the bearing groove 60 with any depth that differs on a per product basis for tolerance. The bearing holder 30, which is to be mounted in a manner to be in contact at its any part with the bearing groove 60, can be easily fitted. Further, the bearing holder 30 can be easily designed when compared with a rectangular bearing holder. The bearing holder 30 having such a simple configuration can hold the bearing 40, thereby achieving easy fitting and design.

The bearing holder 30 is engaged with the bearing groove 60 such that either the first or second contact surface 31 or 32 of the bearing holder 30 is in parallel to the radial direction of the pressure roller 26. The configuration as above can increase the contact area where the first or second contact surface 31 or 32 of the bearing holder 30 is in contact with the first or second side surface 62 or 63 of the bearing groove 60. As a result, the bearing holder 30 can firmly hold the bearing 40.

Either the first or second contact surface 31 or 32 is in contact with the entirety of a corresponding one of the first and second side surfaces 62 and 63. The configuration as above can increase the contact area where either the first or second contact surface 31 or 32 of the bearing holder 30 is in contact with a corresponding one of the first and second side surfaces 62 and 63 of the bearing groove 60. As a result, the bearing holder 30 can firmly hold the bearing 40.

The bearing holder 30 has an interrupted annular shape. When the bearing holder 30 is engaged with the bearing 40, residual stress is generated in the bearing holder 30, so that the bearing holder 30 throttles the bearing 40. As a result, the bearing holder 30 can firmly hold the bearing 40.

Second Embodiment

Figure 5:
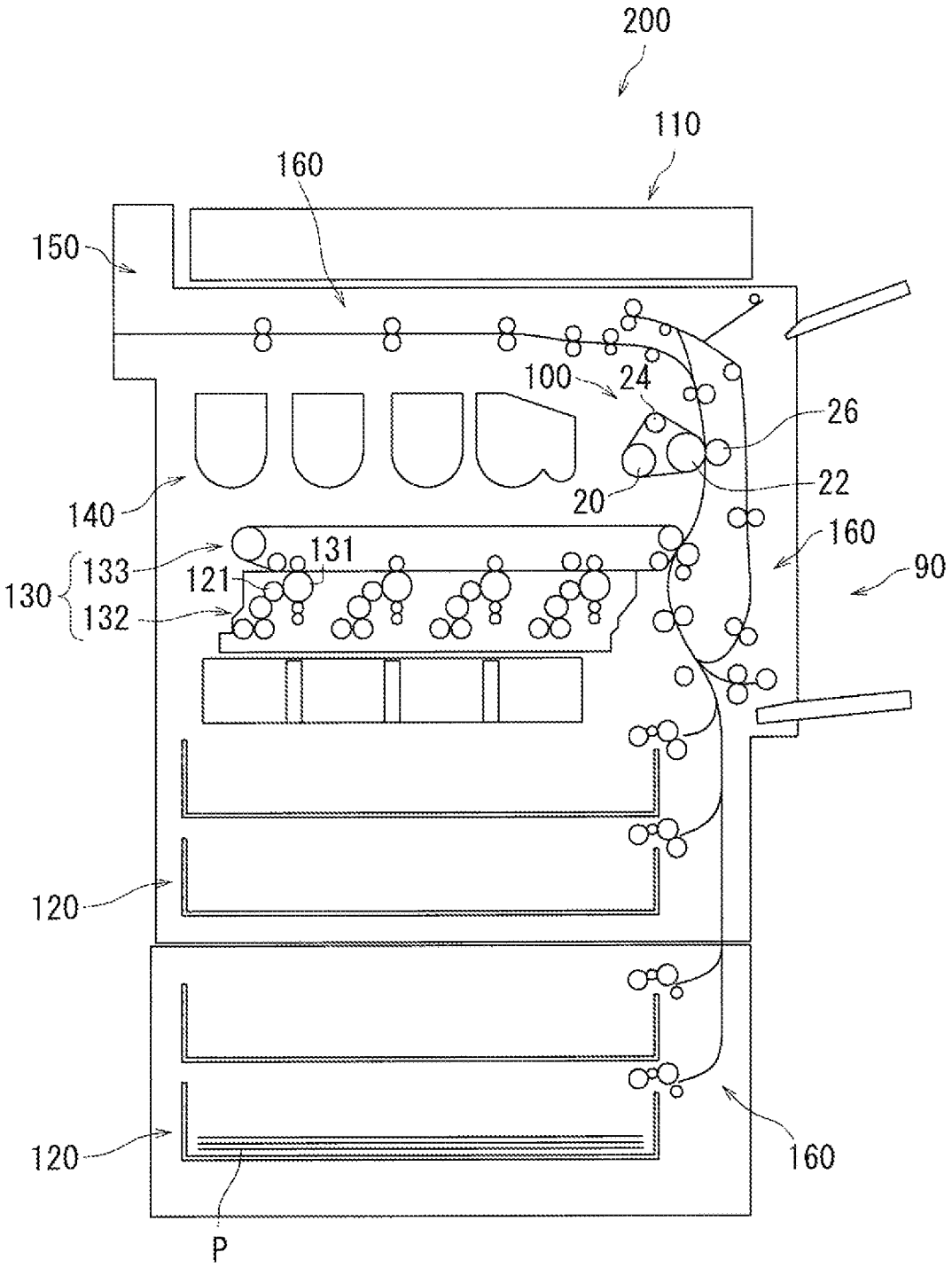
FIG. 5 is a schematic diagram of an image forming apparatus according to a second embodiment of the present disclosure.

FIG. 5 is a schematic diagram illustrating an image forming apparatus 200 according to a second embodiment of the present disclosure. The image forming apparatus 200 may be a copier, a printer, a facsimile machine, or a multifunction peripheral having functions of them. A copier will be discussed below as an example of the image forming apparatus 200, which however should not be taken to limit the present disclosure.

The image forming apparatus 200 includes the fixing device 100, an image reading section 110, and an image forming section 90. The image forming section 90 includes a sheet feed cassette 120, an imaging section 130, a toner replenishment device 140, a sheet ejecting section 150, and a sheet conveyance section 160. The image forming section 90 forms an image based on image data read by the image reading section 110.

The sheet feed cassette 120 accommodates sheets P for printing. In copying, the sheets P in the sheet feed cassette 120 are conveyed, one at a time, by the sheet conveyance section 160 via the imaging section 130 and the fixing device 100 and ejected from the sheet ejecting section 150.

The imaging section 130 forms an image on a sheet P. The imaging section 130 includes a photosensitive member 131, a developing device 132, and a transfer device 133.

The photosensitive member 131 is irradiated with a laser based on image data of an original document that has been generated by the image reading section 110 to form an electrostatic latent image. The developing device 132 includes a development roller 121. The development roller 121 develops the electrostatic latent image by supplying toner to the photosensitive member 131, thereby forming a toner image on the photosensitive member 131. The toner is replenished from the toner replenishment device 140 to the developing device 132.

The transfer device 133 transfers the toner image formed on the photosensitive member 131 to the sheet P.

The fixing device 100 fixes the toner to the sheet P in a manner to apply heat and pressure to the sheet P to melt unfixed toner of the toner image formed by the imaging section 130.

The embodiments of the present disclosure have been described so far with reference to FIGS. 1A-5. However, the present disclosure is not limited to the above embodiments, and various alterations are possible within the scope not departing from the gist of the present disclosure. For example, the following three alterations are possible. The drawings are schematic illustrations that emphasize the configuration of elements in order to facilitate understanding thereof. Therefore, in order that the elements can be easily illustrated in the drawings, properties of each of the elements, such as thickness, length, and number thereof, may differ from actual properties thereof. The materials, shapes, dimensions, etc. of each illustrated element are examples in the above embodiments and should not be limited. A variety of variations thereof are possible within the scope not substantially departing from the subject matter of the present disclosure.

(1) The bearing holder 30 of the fixing device 100 according to the first and second embodiments is located at the pressure roller 26. However, the rotary member at which the bearing holder 30 is located is not limited to the pressure roller. For example, the bearing holder 30 may be located at each of the heating roller 20 and the fixing roller 22.

(2) The heater in the fixing device 100 according to the first and second embodiments is provided in the interior of the heating roller 20, but may be provided in the exterior of the heating roller 20. For example, a heater of induction heating (IH) type including an induction coil may be provided in the exterior of the heating roller 20 for heating the belt 10.

(3) The fixing device 100 according to each of the first and second embodiments performs fixing using the belt 10 but may perform fixing using a heating roller.

What is claimed is:

1. A fixing device for fixing a toner to a recording medium, comprising:

a rotary member rotatable about an axis of rotation of the rotary member;

a bearing disposed around an end part of the rotary member; and a bearing holder configured to hold the bearing, wherein the bearing has an outer circumferential surface with a flat portion and a bearing groove, the bearing groove has a bottom surface, a first side surface, and a second side surface, the first side surface of the bearing groove is capable of being in contact with the bearing holder, the second side surface of the bearing groove is capable of being in contact with the bearing holder, the bearing holder has:

a first contact surface in contact with the first side surface of the bearing groove; and a second contact surface in contact with the second side surface of the bearing groove;

a connecting surface that connects the first contact surface to the second contact surface, the connecting surface is in contact with the bottom surface, the bearing holder engages with the bearing groove such that the first contact surface has a first abutting part that is in contact with the first side surface, and the second contact surface has a second abutting part that is in contact with the second side surface, the bearing groove further has:

a first rim defined by the first side surface and the flat portion; and a second rim defined by the second side surface and the flat portion, the bearing holder is in contact with the bearing at at least the first and second rims of the bearing groove, and at least one of the first contact surface and the second contact surface is out of contact with the bearing groove between the connecting surface and at least one of the first and second abutting parts.

2. The fixing device according to claim 1, wherein the bearing holder has a thickness on an inside of the bearing groove and a thickness on an outside of the bearing groove, the thickness on an inside of the bearing groove being smaller than the thickness on an outside of the bearing groove.

3. The fixing device according to claim 1, wherein at least one of the first and second contact surfaces of the bearing holder inclines relative to a direction perpendicular to the axis of rotation of the rotary member.

4. The fixing device according to claim 1, wherein the bearing holder is engaged with the bearing groove such that either the first or second contact surface of the bearing holder is in parallel to a direction perpendicular to the axis of rotation of the rotary member.

5. The fixing device according to claim 1, wherein either the first or second contact surface of the bearing holder is in contact with an entirety of a corresponding one of the first and second side surfaces.

6. The fixing device according to claim 1, wherein the bearing holder has an interrupted annular shape.

7. An image forming apparatus, comprising:

the fixing device according to claim 1; and an image forming section configured to transfer a toner image to a recording medium, wherein the fixing device fixes the toner image to the recording medium.

8. The fixing device according to claim 1, further comprising a frame, wherein the bearing holder is mounted on the frame by a fixing member.

9. The fixing device according to claim 1, wherein one of the first contact surface and the second contact surface of the bearing holder is in contact with an entirety of the first side surface or the second side surface of the bearing groove, and a part of the other of the first contact surface and the second contact surface of the bearing holder is in contact with the first rim or the second rim and another part of the other of the first contact surface and the second contact surface of the bearing holder is out of contact with the first side surface or the second side surface of the bearing groove.

10. The fixing device according to claim 1, wherein the bearing holder has a thickness at the first and second rims that is equal to a distance between the first and second rims, and the bearing holder has a thickness at the connecting surface that is smaller than the distance between the first and second rims.

* * * * *